United States Patent [19]

Parant et al.

[11] 4,153,478

[45] May 8, 1979

[54] PROCESS FOR TREATMENT OF METALLIC SURFACES BY MEANS OF FLUOROPHOSPHATE SALTS

[75] Inventors: Bernard Parant, Ozoir-La-Ferriere; Louis Cot, Montpellier; William Granier, Clapiers; Jean-Henri Durand, Montpellier, all of France

[73] Assignee: The Diversey Corporation, Chicago, Ill.

[21] Appl. No.: 877,829

[22] Filed: Feb. 15, 1978

Related U.S. Application Data

[62] Division of Ser. No. 789,658, Apr. 21, 1977.

[30] Foreign Application Priority Data

Apr. 21, 1976 [FR] France ..... 76 11738

[51] Int. Cl.[2] ..... C23F 7/08

[52] U.S. Cl. ..... 148/6.15 R; 148/6.15 Z; 148/6.27

[58] Field of Search ..... 148/6.14 R, 6.15 R, 148/6.15 Z, 6.27; 106/14; 424/52

[56] References Cited

U.S. PATENT DOCUMENTS 3,342,687 9/1967 Gould ..... 424/52

FOREIGN PATENT DOCUMENTS 843054 8/1960 United Kingdom ..... 148/6.15 R
1045297 10/1966 United Kingdom ..... 148/6.15 Z

*Primary Examiner*—Ralph S. Kendall
*Attorney, Agent, or Firm*—Merriam, Marshall & Bicknell

[57] ABSTRACT

Steel, aluminum and aluminum alloys, zinc and zinc alloys are treated to improve corrosion resistance with an aqueous solution of a fluorophosphate salt to passivate the metal surface, before or after phosphatizing and prior to painting.

14 Claims, No Drawings

PROCESS FOR TREATMENT OF METALLIC SURFACES BY MEANS OF FLUOROPHOSPHATE SALTS

This is a division of application Ser. No. 789,658 filed Apr. 21, 1977.

The present invention relates to the novel application of fluorophosphate salts for the treatment of metal surfaces. More particularly, it relates to a process for the treatment of metal surfaces by means of an aqueous solution of a fluorophosphate salt, as well as compositions containing at least one fluorophosphate salt for use in the process.

It is to be understood that by treatment of metal surfaces is meant passivation and the preparation of metal surfaces for painting. The metals which can be treated according to the present invention are more particularly steels, aluminum and its alloys and zinc and its alloys.

It is known to those skilled in the art that for the treatment of metal surfaces, and specifically passivation and paint bonding, oxy chromium-(VI)-compounds are used which, however, have the disadvantages of being toxic and having carcinogenic action.

An object of the invention is to provide metal treating compositions which are less toxic than those containing chromium-(VI)-compounds with respect to use for passivation of metal surface. The treatment may also be used to prepare metal surfaces for painting.

The present invention in part provides aqueous use solutions for the treatment of metal surfaces. The use solutions comprise water containing at least one fluorophosphate salt selected from the compounds of the following formulas and hydrates thereof:

(a) $M_2^{I}PO_3F$
(b) $LiM^{I}PO_3F$
(c) $NaM^{I}PO_3F$
(d) $M^{II}PO_3F$
(e) $M_2^{I}M^{II}(PO_3F)_2$, and
(f) $M_2^{III}(PO_3F)_3$ wherein $M^{I}$ represents Na, K, Rb, Cs and $NH_4$; $M^{II}$ represents Cd, Mn, Ni and Zn, and $M^{III}$ represents Cr, Fe or Al. The compounds may be nonhydrated or hydrated and may contain up to 24 or more moles of water.

The fluorophosphate salts generally most suitable for use in the use or working solutions, and in solid premix concentrates, of the invention are those of the formulas:

(1) $M_2^{I}PO_3F.n\ H_2O$ wherein $M^{I}$ represents Na, K, Rb, Cs and $NH_4$ and n is 1 when $M^{I}$ is $NH_4$ and n is O when $M^{I}$ is Na, K, Rb and Cs;

(2) $Li\ M^{I}\ PO_3F.n\ H_2O$ wherein $M^{I}$ represents Na, K, Rb, Cs and $NH_4$ and n is O no matter which listed element $M^{I}$ represents, n can be 1 when $M^{I}$ is K and n is 3 when $M^{I}$ is Na;

(3) $Na\ M^{I}\ PO_3F.\ n\ H_2O$ wherein $M^{I}$ represents K, Rb and $NH_4$, n is 1 when $M^{I}$ is $NH_4$ and n is O when $M^{I}$ is K or Rb;

(4) $M^{II}\ PO_3F.n\ H_2O$ wherein $M^{II}$ represents Cd, Mn, Ni and Zn, n is 8/3 when $M^{II}$ is Cd, n is 4 when $M^{II}$ is Mn and n is 6 when $M^{II}$ is Zn or Ni;

(5) $M_2^{I}M^{II}\ (PO_3F)_2.n\ H_2O$ wherein $M^{I}$ represents K or $NH_4$, $M^{II}$ is Ni or Zn and n is 6 when $M^{I}$ is $NH_4$ and n is 2 when $M^{I}$ is K; and (6) $M_2^{III}(PO_3F)_3.n\ H_2O$ wherein $M^{III}$ is trivalent Cr, Fe and Al and n is O to 24.

Sodium fluorophosphate ($Na_2PO_3F$) and potassium fluorophosphate ($K_2PO_3F$) are presently considered the salts of choice for use in the invention because they are very effective and low cost. The best salt is now believed to be the potassium salt, especially when used in combination with potassium hydroxide in use solutions.

Some publications disclosing compounds within the scope of the invention are J. Indian Chem. Soc. 14, 660–666 (1937) and 41, 407–410 (1964); Chem. Ab. 32, 3717 (1938) and 61, 12924 (1964); and Chem. Ber. 62, 793–801 (1929). Ozark-Mahoning Company, Tulsa, Oklahoma is a commercial source for some of the compounds.

The use solutions will contain an effective amount, up to its maximum solubility in water, of at least one such compound in water. A concentration of about 0.25 to 100 g, and preferably about 2 to 10 g, of one or more of the compounds per liter of use solution is suitable for treating metal surfaces. From about 0.04 to 4.0 g per liter of use solution of an alkali metal hydroxide such as sodium or potassium hydroxide may be included in the use solution to give a desired alkaline pH. For paint adherence treatment of metal surfaces better results are obtained with potassium hydroxide than sodium hydroxide.

The use solutions may also include one or more suitable surfactants, which may be amphoteric, cationic, anionic or nonionic. Some suitable surfactants which may be included in the use solutions are octylphenoxy poly(ethyleneoxy)ethanol, polyoxyethylene sorbitol oleate, diethanolamine fatty acid amide, sodium lauryl sulfate, fluorinated anionic surfactant (Florochemical FC-95) and sorbitan monooleate. Including a surfactant, such as in the range of 0.1 to 5% by weight, in a use solution generally will aid in wetting the metal surface to be treated and in subsequent rinsing of the treated surface.

In order to facilitate the preparation of use or working solutions for treating metal, the subject invention also provides premix concentrates which constitute commercial products from which use solutions can be conveniently prepared. These premix concentrates will generally be solids in particulate form since the relatively low solubility of the fluorophosphate salts does not facilitate production of liquid premixes containing high amounts of one or more of the salts. The solid premix concentrates will advisably contain about 10 to 90% by weight of one or more of the herein described fluorophosphate salts in admixture with a solid particulate basic material which may be, for example, an alkali metal hydroxide, i.e. sodium hydroxide or potassium hydroxide. Preferred solid compositions contain sodium or potassium fluorophosphate mixed with sodium or potassium hydroxide. About 0.5 to 20% by weight of a surfactant, such as previously described herein, may be included in the premix for the advantages previously mentioned with respect to the use solutions.

The process according to the invention relates to the passivation and preparation of a metal part prior to painting. The process comprises treating the said part with an aqueous solution containing about 0.25 to 100 g per liter of one or more fluorophosphate salts, advisably for at least one minute, at an elevated temperature such as between 15° and 80° C. Preferably, the metal part is immersed in an acidic or alkaline aqueous solution, in particular at a pH between about 5 to 13, containing one or more of the fluorophosphate salts. Any suitable acid or base may be included in the composition to produce the desired pH. An alkali metal hydroxide such as potassium hydroxide or sodium hydroxide is advisably used. An amount of base which yields a pH of about 10 to 13 gives particularly good results. Alternatively, an acid such as phosphoric acid may be used to produce an acidic pH. Although other acids and bases may be used it is generally more practical to use those which have been named since they are least costly and widely available.

The treatment according to the invention can be performed after degreasing the metal part. If the metal part is made from steel the treatment of the invention can be carried out before or after phosphatizing the said part. The purpose of the phosphatizing process is to protect the steel surface against corrosion by the formation of an iron phosphate coating in the case of amorphous phosphatization, or an iron and zinc phosphate coating in the case of a crystalline phosphatization. The coating has characteristics such that it provides a base for the adherence of paint.

Phosphatization is a conventional process applied to most steel parts prior to painting (vehicle bodies, tubes, sheets, etc.). Moreover, it must be remembered that although phosphatizing improves corrosion resistance, it is not sufficient to prevent parts from rusting when they are stored between phosphatization and painting. This is the reason why hitherto there was an additional treatment of the metal part surface with an oxy chromium-(VI)-compound, and more specifically chromic anhydride. According to the invention this latter treatment is replaced by treatment of the metal part surface with a solution of one or more fluorophosphate salts in water.

The following examples are set forth to illustrate the advantages of the process of this invention but it is to be understood that they are not to be construed as limitative of the invention.

EXAMPLE 1

An SPCI steel (French designation) sheet was degreased and exposed to an amorphous phosphatziing bath under the following conditions: during processing in a spraying tunnel the part was first treated with a phosphatization product containing 90% by weight of sodium dihydrogen phosphate, 5% by weight of a nonionic surfactant, 4% by weight of butylglycol and 1% by weight of sodium molybdate and used in a concentration of 10 g/l at a temperature of 70° C. for 1½ minutes.

After rinsing the phosphatized sheet, passivation according to the invention is carried out in a hot aqueous solution (50°–70° C.) containing 6 g/l of $K_2PO_3F$ (the pH having been adjusted to 12 by adding KOH) for about 20 to 60 seconds.

The thus treated sheet was compared with an identical sheet for which passivation was carried out with chromic anhydride at the same concentration (6 g/l). It was found that the sheet (unpainted) treated according to the invention was able to resist a salt fog spray for 16 hours, whereas that treated with chromic anhydride only resisted for 7 hours.

EXAMPLE 2

A truck chassis made of mild AG4 MC steel (French designation) parts and with various zinc-coated or galvanized parts was exposed to an amorphous phosphating solution at 60° C. for 2 minutes.

Following rinsing, passivation was carried out in a solution of 0.8 g/l of $NiPO_3F.6H_2O$, adjusted to pH 12 by adding KOH, for about 20 to 60 seconds.

The surfaces (unpainted) treated in this way had a resistance to salt spray fog of 16 hours, as compared with 6 hours resistance for surfaces treated with chromic anhydride. Furthermore, paint adhesion tests performed according to French Standard NF T 30 038 yield a 100% rating with respect to glycerophthalic paint in the case of surfaces treated according to the invention. Treatment with chromic anhydride gave an identical paint adhesion reading.

EXAMPLE 3

To an aqueous solution of $NiPO_3F$ (mol wt. 156.7) was added a stoichiometric amount of $(NH_4)_2PO_3F$. Then acetone or alcohol was added to precipitate $(NH_4)_2Ni(PO_3F)_2$. The precipitate was filtered and dried using acetone to obtain a green powder. If dried in an oven it decomposes to a dihydrate yellow compound with release of 4 moles of water.

A steel panel was coated with a zinc phosphate composition DIVERPHOS Z1 containing 25% by weight of phosphoric acid, 30% by weight of nitric acid, 15% by weight of zinc oxide and 30% by weight of water used at a concentration of 30 g/l at a temperature of 50° C. for 3 minutes to deposit a crystalline zinc phosphate coating.

The panel was then rinsed in water and passivated in an aqueous solution adjusted to pH 12 by KOH and containing 0.8 g/l of $(NH_4)_2Ni(PO_3F)_2.6H_2O$ for about 20 to 60 seconds at a temperature of 80° C.

It was found that this panel (unpainted) had a resistance to salt spray fog of 36 hours and had 100% paint adhesion in accordance with French Standard T 30 038 AFNOR designation.

EXAMPLE 4

A steel panel was coated with a zinc crystalline phosphatizing composition DIVERPHOS Z1 (Example 3) at a concentration of 30 g/l at 50° C. for 3 minutes. The panel was then rinsed and passivated for about 20 to 60 seconds in an aqueous solution containing 1 g/l of the followng mixture:

80% by weight of $K_2PO_3F$
10% by weight of sodium nitrite
10% by weight of borax The salt spray fog resistance (unpainted) was 30 hours and the paint adhesion 100% in accordance with French Standard T 30 038 with respect to glycerophthalic paint.

EXAMPLE 5

An SPCI steel panel was degreased and exposed to an amorphous phosphatizing solution under the conditions described in Example 1. Following rinsing, the phosphatized panel was passivated in a hot aqueous solution at pH 10 and containing 3 g/l of $(NH_4)_2PO_3F.H_2O$ and 3 g/l of $Ni(NO_3)_2$ for about 20 to 60 seconds.

The salt spray fog resistance (unpainted) of the thus treated sheet was 18 hours and the paint adhesion 100% according to French Standard T 30 038 with respect to glycerophthalic paint.

EXAMPLE 6

An SPCI steel panel was degreased and exposed to a phosphatizing solution under the conditions described in Example 1.

After rinsing, the panel was passivated by means of a hot aqueous solution at pH 5 containing 2 g/l of $ZnPO_3F.6H_2O$ and 1 g/l of tannic acid for approximately 20 to 60 seconds.

The salt spray fog resistance (unpainted) was 14 hours and the paint adhesion was 100% according to French Standard designation T 30 038 with respect to glycerophthalic paint.

EXAMPLE 7

To a plastic beaker containing a minimum amount of water is added 10 g of $(NH_4)_2PO_3F$, 7.53 g of $KNO_3$ and 10.85 g of $Ni(NO_3)_2.6H_2O$. After the solids are dissolved the beaker is put on a water bath at 50° C. for one hour. Alcohol or acetone is then added to the cooled solution to precipitate $K_2Ni(PO_3F)_2.2H_2O$. The product is filtered, washed with alcohol and dried with acetone to yield a turquoise powder.

The foregoing detailed description has been given for clearness of understanding only, and no unnecessary limitations should be understood therefrom, as modifications will be obvious to those skilled in the art.

What is claimed is:

1. A process for the treatment of a steel, aluminum, aluminum alloy, zinc or zinc alloy metal surface for the passivation and preparation thereof prior to painting which comprises containing the metal surface with a chromium-free composition at a pH of 5 to 13 comprising water and at least one fluorophosphate salt, in an amount to effectively passivate the metal surface, selected from the compounds of the following formulas and hydrates thereof:

(a) $M_2^{I}PO_3F$ (b) Li $M^{I}PO_3F$ (c) Na $M^{I}PO_3F$ (d) $M^{II}PO_3F$ (e) $M_2^{I}M^{II}(PO_3F)_2$, and (f) $M_2^{III}(PO_3F)_3$ wherein $M^1$ represents Na, K, Rb, Cs and $NH_4$; $M^{II}$ represents Cd, Mn and Ni and $M^{III}$ represents Cr, Fe and Al.

2. A process according to claim 1 in which the composition contains at least one compound of the formula $M_2^{I}PO_3F.n\ H_2O$ wherein $M^{I}$ represents Na, K, Rb, Cs and $NH_4$, n is 1 when $M^{I}$ is $NH_4$ and n is 0 when M is Na, K, Rb or Cs.

3. A process according to claim 1 in which the composition contains at least one compound of the formula $LiM^{I}PO_3F.n\ H_2O$ wherein $M^{I}$ represents Na, K, Rb, Cs and $NH_4$, n is 0 no matter which listed element $M^{I}$ represents, n is 1 when $M^{I}$ is K and n is 3 when $M^{I}$ is Na.

4. A process according to claim 1 in which the composition contains at least one compound of the formula Na $M^{I}PO_3F.n\ H_2O$ wherein $M^{I}$ represents K, Rb and $NH_4$, n is 1 when $M^{I}$ is $NH_4$ and n is 0 when $M^{I}$ is K or Rb.

5. A process according to claim 1 in which the composition contains at least one compound of the formula $M^{II}PO_3F.n\ H_2O$ wherein $M^{II}$ represents Cd, Mn, Ni and Zn, n is 8/3 when $M^{II}$ is Cd, n is 4 when $M^{II}$ is Mn and n is 6 when $M^{II}$ is Zn or Ni.

6. A process according to claim 1 in which the composition contains at least one compound of the formula $M_2^{I}M^{II}(PO_3F)_2.n\ H_2O$ wherein $M^{I}$ is K or $NH_4$, $M^{II}$ represents Ni or Zn, n is 6 when $M^{I}$ is $NH_4$ and n is 2 when $M^{I}$ is K.

7. A process according to claim 1 in which the composition contains at least one compound of the formula $M_2^{III}(PO_3F)_3.n\ H_2O$ wherein $M^{III}$ represents Cr, Fe or Al and n is a number from 0 to 24.

8. A process according to claim 1 in which the composition is at a temperature between 15° and 80° C.

9. A process according to claim 1 in which the composition contains a surfactant.

10. A process according to claim 1 wherein the process is performed after a degreasing operation.

11. A process according to claim 1 wherein the surface is steel and it has previously been phosphatized.

12. A process according to claim 1 in which the composition contains sodium fluorophosphate.

13. A process according to claim 1 in which the composition contains potassium fluorophosphate.

14. A process according to claim 1 in which the composition contains potassium hydroxide.

* * * * *

UNITED STATES PATENT AND TRADEMARK OFFICE

CERTIFICATE OF CORRECTION

PATENT NO. : 4,153,478

DATED : May 8, 1979

INVENTOR(S) : BERNARD PARANT, LOUIS COT, WILLIAM GRANIER and JEAN-HENRI DURAND

It is certified that error appears in the above-identified patent and that said Letters Patent are hereby corrected as shown below:

Column 1, line 28, change "surface" to -- surfaces --.

Column 5, line 45, change "containing" to -- contacting --

Signed and Sealed this

*Tenth* Day of *July 1979*

[SEAL]

*Attest:*

*Attesting Officer*

LUTRELLE F. PARKER

*Acting Commissioner of Patents and Trademarks*